US007103977B2

(12) United States Patent
Guimont

(10) Patent No.: US 7,103,977 B2
(45) Date of Patent: Sep. 12, 2006

(54) RAZOR HAVING A MICROFLUIDIC SHAVING AID DELIVERY SYSTEM AND METHOD OF EJECTING SHAVING AID

(75) Inventor: Raymond Guimont, Guilford, CT (US)

(73) Assignee: Eveready Battery Company, Inc., St. Louis, MO (US)

( * ) Notice: Subject to any disclaimer, the term of this patent is extended or adjusted under 35 U.S.C. 154(b) by 0 days.

(21) Appl. No.: 10/643,365

(22) Filed: Aug. 19, 2003

(65) Prior Publication Data

US 2004/0078986 A1 Apr. 29, 2004

Related U.S. Application Data

(60) Provisional application No. 60/405,255, filed on Aug. 21, 2002.

(51) Int. Cl.
*B26B 21/44* (2006.01)

(52) U.S. Cl. ..... 30/41; 30/41.5; 30/538

(58) Field of Classification Search ..... 30/41, 30/41.5, 538, 50

See application file for complete search history.

(56) References Cited

U.S. PATENT DOCUMENTS

| | | | | |
|---|---|---|---|---|
| 3,468,331 | A | 9/1969 | O'Neal | |
| 3,495,604 | A | 2/1970 | Trask, II | |
| 3,495,608 | A | 2/1970 | O'Keefe | |
| 3,528,445 | A | 9/1970 | Shinn et al. | |
| 3,534,757 | A | 10/1970 | Doherty | |
| 3,548,849 | A | 12/1970 | Purcell | |
| 3,587,614 | A | 6/1971 | Burke | |
| 3,587,615 | A | 6/1971 | Thomson | |
| 3,604,417 | A | 9/1971 | Stolzenberg | |
| 3,658,088 | A | 4/1972 | Jensen et al. | |
| 3,731,700 | A | 5/1973 | Cohen | |
| 3,747,628 | A | 7/1973 | Holster et al. | |
| 3,811,474 | A | 5/1974 | Bauer et al. | |
| 4,012,551 | A | 3/1977 | Bogaty et al. | |
| 4,238,882 | A | 12/1980 | Harrison, Sr. | |
| 4,272,885 | A | 6/1981 | Ferraro | |
| 4,340,048 | A | 7/1982 | Eckenhoff | |
| 4,716,652 | A * | 1/1988 | Cataudella | 30/41 |
| 4,809,432 | A | 3/1989 | Schauble | |
| 4,868,982 | A | 9/1989 | McComas | |
| 4,872,263 | A | 10/1989 | Etheredge, III | |
| 4,880,631 | A | 11/1989 | Haslam et al. | |
| 4,984,364 | A | 1/1991 | Simmons | |
| 5,072,512 | A * | 12/1991 | Noujain | 30/41.5 |

(Continued)

FOREIGN PATENT DOCUMENTS

EP 0 854 018 A1 7/1998

(Continued)

OTHER PUBLICATIONS

WTEC Hyper-Librarian, "MEMS/Microsystems Device and Process Technologies", Jan. 2000, pp. 1-25, Section 5.

(Continued)

*Primary Examiner*—Stephen Choi
(74) *Attorney, Agent, or Firm*—Michaud-Duffy Group LLP

(57) ABSTRACT

A razor assembly includes a razor head having at least one blade, and a shaving aid delivery system disposed within the razor head. The shaving aid delivery system includes a supply of at least one shaving aid fluid, a microfluidic circuit for communicating the shaving aid fluid from the supply to a plurality of outlet ports along a surface of the shaving aid delivery system, and a transport system for driving the shaving aid fluid from the supply through the microfluidic circuit.

16 Claims, 5 Drawing Sheets

U.S. PATENT DOCUMENTS

| | | | | |
|---|---|---|---|---|
| 5,134,775 | A * | 8/1992 | Althaus et al. | 30/41 |
| 5,263,256 | A | 11/1993 | Trankiem | |
| 5,279,608 | A * | 1/1994 | Cherif Cheikh | 604/892.1 |
| 5,283,952 | A | 2/1994 | Mock et al. | |
| 5,331,740 | A | 7/1994 | Carson, III et al. | |
| 5,377,409 | A | 1/1995 | Chen | |
| 5,384,961 | A | 1/1995 | Gregory | |
| 5,412,872 | A | 5/1995 | Iderosa | |
| 5,417,235 | A | 5/1995 | Wise et al. | |
| 5,635,358 | A | 6/1997 | Wilding et al. | |
| 5,637,469 | A | 6/1997 | Wilding et al. | |
| 5,645,894 | A | 7/1997 | Trankiem | |
| 5,660,703 | A | 8/1997 | Dasgupta | |
| 5,672,167 | A | 9/1997 | Athayde et al. | |
| 5,711,076 | A | 1/1998 | Yin et al. | |
| 5,876,675 | A | 3/1999 | Kennedy | |
| 5,903,979 | A | 5/1999 | Oldroyd | |
| 5,985,459 | A | 11/1999 | Kwiecien et al. | |
| 6,103,199 | A | 8/2000 | Bjornson et al. | |
| 6,167,910 | B1 | 1/2001 | Chow | |
| 6,269,846 | B1 | 8/2001 | Overbeck et al. | |
| 6,281,254 | B1 | 8/2001 | Nakajima et al. | |
| 6,306,273 | B1 | 10/2001 | Wainright et al. | |
| 6,473,970 | B1 * | 11/2002 | Prochaska | 30/41 |
| 6,851,190 | B1 * | 2/2005 | Guimont et al. | 30/41 |
| 2003/0154832 | A1 | 8/2003 | Guimont et al. | |
| 2004/0109793 | A1 * | 6/2004 | McNeely et al. | 422/100 |

FOREIGN PATENT DOCUMENTS

| | | | |
|---|---|---|---|
| EP | 0 854 019 | A1 | 7/1998 |
| EP | 0 960 699 | A1 | 12/1999 |
| WO | WO 03/064122 | A1 | 8/2003 |
| WO | WO-2004/017785 | * | 3/2004 |

OTHER PUBLICATIONS

Aclara, "Microfluidic Devices", pp. 1-2.

Aclara, "How the Technology Works", p. 1.

Aclara, "Plastic LabCard™ Device Fabrication", pp. 1-2.

BioMicro Technologies Systems, "Passive Fluid Control Micro Fluid Analysis, Liquid Mixing", p. 1.

BioMicro Technologies Systems, "Passive Fluid Control Micro Analysis, Liquid Division", pp. 1-2.

BioMicro Technologies Systems, "Passive Fluid Control Micro Fluid Analysis, Sequential Liquid Delivery", pp. 1-2.

BioMicro Technologies Systems, "Passive Fluid Control Micro Fluid Analysis, Consolidation", p. 1.

BioMicro Technologies Systems, "Passive Fluid Control Micro Fluid Analysis, Ablate Well", p. 1.

BioMicro Technologies Systems, "Passive Fluid Control Micro Fluid Analysis, Ablate Channel", p. 1.

J. Michael Ramsey, U. S. Department of Energy, "Lab-on-a-Chip Technologies", Oak Ridge National Laboratory, pp. 1-2.

Alzet® Osmotic Pumps, "A General Description", 2001, Durect Corporation, p. 1.

Alzet® Osmotic Pumps, "Specifications and Materials", 2001, Durect Corporation, pp. 1-3.

* cited by examiner

RAZOR HAVING A MICROFLUIDIC SHAVING AID DELIVERY SYSTEM AND METHOD OF EJECTING SHAVING AID

CROSS-REFERENCE TO RELATED APPLICATIONS

This application is entitled to the benefit of and incorporates by reference essential subject matter disclosed in Provisional Patent Application No. 60/405,255 filed on Aug. 21, 2002.

FIELD OF THE INVENTION

The present disclosure relates to a shaving system having a lubricating shaving aid for providing skin care topicals as well as improving the ease with which a razor can be drawn across the skin during the shaving process. More particularly, the present disclosure relates to a shaving system having a microfluidic system for the controlled delivery of shaving aid.

BACKGROUND OF THE INVENTION

It is known that many factors contribute to overall discomfort during the shaving process. Such factors include excessive frictional drag of the razor across the skin and the inflammation of the skin caused by various known epidermal conditions such as psoriasis, eczema, acne, skin rashes, etc. Efforts to address some of these factors have led to the use of pre-shave and/or aftershave lotions which include emollients, beard softening agents, lathering agents, medicinal or soothing ointments, aloe, foam, soaps, and the like. Even though shaving comfort may be enhanced to some degree using emollients and other shaving aids, the requirement that they be applied before or after shaving tends to decrease their overall effectiveness and simply adds to the complications of the shaving process.

Shaving systems also use lubricants to decrease the frictional resistance during shaving. For example, static lubricating systems integrated with or attached to the razor cartridge are well known and help reduce the frictional drag of the razor as it is drawn across the skin. Such systems include lubricating strips affixed to the razor head proximate the razor cap portion. The lubricating strips typically include a water-insoluble polymer (such as polystyrene) and a water-soluble shaving aid such as polyethylene oxide, which gradually leaches out of the strip during shaving and reduces frictional drag. However, a problem with such systems is that the shaving aid leaches out in a skewed manner over time. At first, more than enough shaving aid leaches out. But after repeated use of the razor, less and less shaving aid leaches out. This results in the inefficient use of the limited quantity of shaving aid which can be incorporated into the lubricant strip. Moreover, the surface of the strip may become irregular and rough after repeated use, thereby increasing the coefficient of friction of the strip. This might contribute to further irritation of sensitive skin.

As a result, various attempts have been made to develop new systems for delivering shaving aid during the shaving process. However, such efforts have for the most part been only partially successful in their ability to consistently and evenly deliver shaving aid to the skin over time and repeated use of the razor.

Accordingly, there yet exists a need for a simple but effective shaving system which incorporates a system for effectively delivering a desired amount of shaving aid automatically or selectively by a user over the course of the normal and expected useful life of the razor blade.

SUMMARY OF THE INVENTION

A razor assembly is provided herein. The razor assembly includes a razor head having at least one blade, and a shaving aid delivery system disposed within the razor head. The shaving aid delivery system includes a supply of at least one shaving aid fluid, a microfluidic circuit for communicating the shaving aid fluid from the supply to a plurality of outlet ports along a surface of the shaving aid delivery system, and a transport system for driving the shaving aid fluid from the supply through the microfluidic circuit.

The razor assembly advantageously provides a convenient method for delivering shaving aid to the shaving surface, and allows for the selection of shaving aids from among two or more shaving aids contained in the shaving aid delivery system.

BRIEF DESCRIPTION OF THE DRAWINGS

Various embodiments are described below with reference to the drawings wherein.

DETAILED DESCRIPTION OF THE PREFERRED EMBODIMENTS

Figure 1:
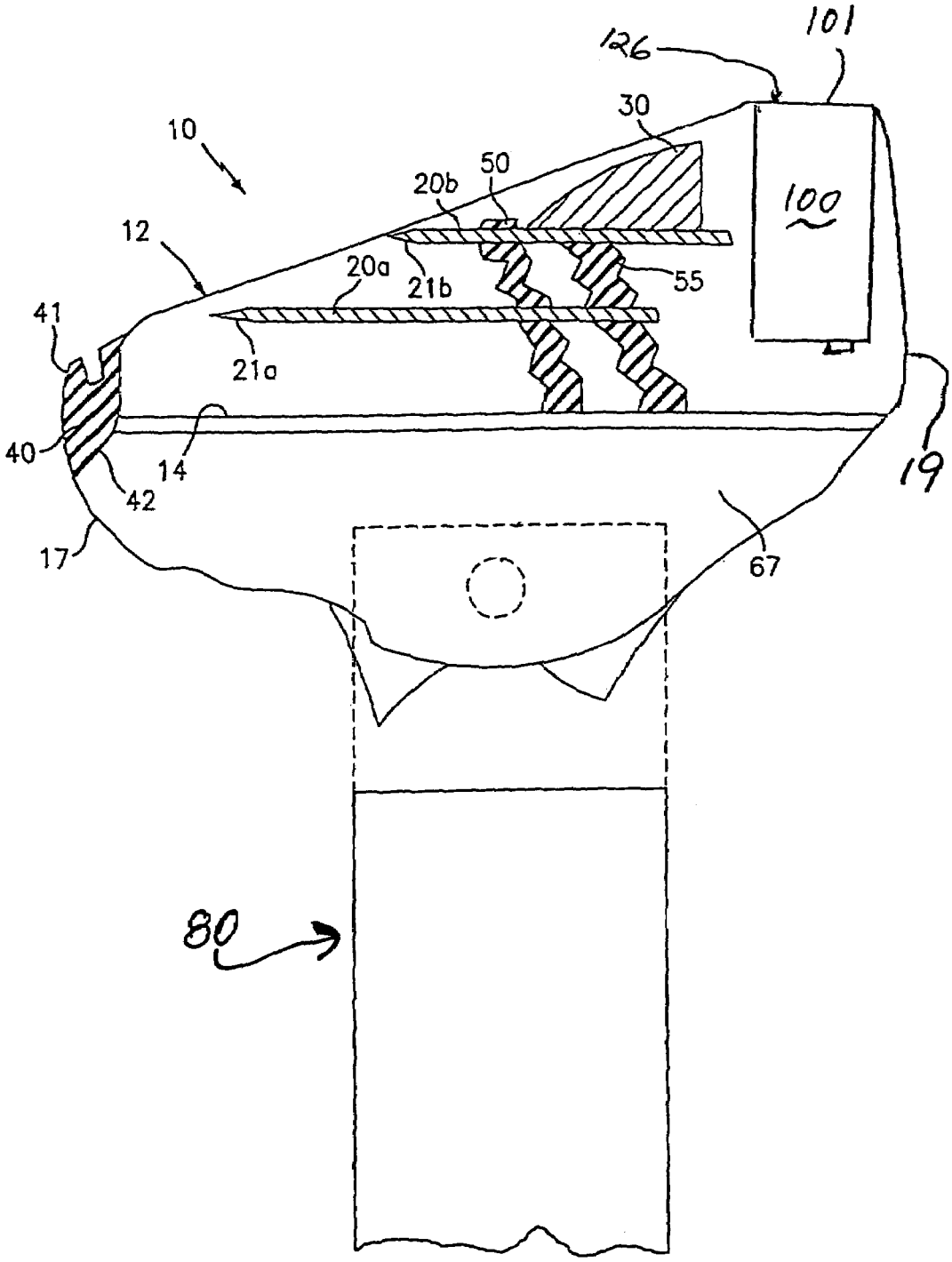
FIG. 1 is a schematic view illustrating a razor assembly including a microfluidic shaving aid delivery system.

The razor assembly herein employs a shaving aid delivery system which includes a microfluidic device. Microfluidic devices have been manufactured using microfabrication methods commonly employed in the electronics industry. Such methods generally involve the fabrication of microscale structures, e.g., grooves, wells, depressions and the like, on the upper planar surface of a first solid substrate material. A second substrate layer having a lower planar surface is then bonded over this surface, which covers and seals the grooves and wells to form the channels and chambers. As a result of these manufacturing techniques, microfluidic devices most often employ a planar structure where, aside from their intrinsic depth, the fluidic elements generally exist in two dimensions.

As used herein, the term "microscale" or "microfabricated" generally refers to structural elements or features of a device which have at least one fabricated dimension in the range of from about 0.1μ to about 500μ. Thus, a device referred to as being microfabricated or microscale will include at least one structural element or feature having such a dimension. When used to describe a fluidic element, such as a passage, chamber or conduit, the terms "microscale," "microfabricated" or "microfluidic" generally refer to one or more fluid passages, chambers or conduits which have at least one internal cross-sectional dimension, e.g., depth, width, length, diameter, etc., that is no more than 500μ, and typically between about 0.1μ and about 500μ.

The microfluidic devices or systems employed in the present invention typically include at least one microscale channel, usually at least two intersecting microscale channels, and often, three or more intersecting channels disposed within a single body structure. Channel intersections may exist in a number of formats, including cross intersections, "T" intersections, or any number of other structures whereby two channels are in fluid communication.

The body structure of the microfluidic devices described herein typically comprises an aggregation of two or more separate substrate layers which, when appropriately mated or joined together, form the microfluidic device of the invention, e.g., containing the multiple channel networks described herein. Preferably, the microfluidic device described herein comprises three substrate layers, including a bottom substrate layer, a middle substrate layer and a top substrate layer.

As used herein, the terms "substrate" or "substrate layer" are used interchangeably to refer to solid planar substrates having first and second opposing, or substantially parallel, planar surfaces. A variety of substrate materials may be employed as the various layers of the device. Typically, because the devices are microfabricated, substrate materials will be selected based upon their compatibility with known microfabrication techniques, e.g., photolithography, wet chemical etching, laser ablation, air abrasion techniques, injection molding, embossing, microreplication, micromolding and other techniques. The substrate materials are also generally selected for their compatibility with the full range of conditions to which the microfluidic devices may be exposed, including extremes of pH, temperature, salt concentration, and application of electric fields. Substrates can also be generally selected for their electrokinetic properties, e.g., surface potential, thermal and optical properties, e.g., transparency etc. Accordingly, in some preferred aspects, the substrate material may include materials normally associated with the semiconductor industry in which such microfabrication techniques are regularly employed, including, e.g., silica based substrates, such as glass, quartz, silicon or polysilicon, as well as other substrate materials, such as gallium arsenide and the like. In the case of semiconductive materials, it will often be desirable to provide an insulating coating or layer, e.g., silicon oxide, over the substrate material, and particularly in those applications where electric fields are to be applied to the device or its contents.

In additional preferred aspects, the substrate materials can comprise polymeric materials, e.g., plastics, such as polymethylmethacrylate (PMMA), polycarbonate, polytetrafluoroethylene (PTFE), polyvinylchloride (PVC), polydimethylsiloxane (PDMS), polysulfone, and the like. Such polymeric substrates are readily manufactured using available microfabrication techniques, as described above, or from microfabricated masters, using well known molding techniques, such as injection molding, embossing or stamping, or by polymerizing the polymeric precursor material within the mold (See U.S. Pat. No. 5,512,131).

Such polymeric substrate materials are preferred for their ease of manufacture, low cost and disposability, as well as their general inertness to most extreme reaction conditions. Again, these polymeric materials may include treated surfaces, e.g., derivatized or coated surfaces, to enhance their utility in the microfluidic system, e.g., provide enhanced fluid direction, e.g., as described in U.S. Pat. No. 5,885,470, and which is incorporated herein by reference in its entirety for all purposes.

As noted above, the various substrate layers of the microfluidic devices are mated or bonded together to form the microfluidic elements of the device. Bonding of substrate layers is generally carried out under any of a number of methods or conditions known in the art. Conditions under which substrates may be bonded together are generally widely understood, and such bonding of substrates is generally carried out by any of a number of methods, which may vary depending upon the nature of the substrate materials used. For example, thermal bonding of substrates may be applied to a number of substrate materials, including, e.g., glass or silica based substrates, as well as polymer based substrates. Such thermal bonding typically comprises mating together the substrates that are to be bonded, under conditions of elevated temperature and, in some cases, application of external pressure. The precise temperatures and pressures will generally vary depending upon the nature of the substrate materials used.

For example, for silica-based substrate materials, i.e., glass (borosilicate glass, Pyrex®, soda lime glass, etc.), quartz, and the like, thermal bonding of substrates is typically carried out by pressing the substrates together at temperatures ranging from about 500° C. to about 1400° C., and preferably, from about 500° C. to about 1200° C. For example, soda lime glass is typically bonded at temperatures around 550° C., whereas borosilicate glass typically is thermally bonded at or near 800° C. Quartz substrates, on the other hand, are typically thermally bonded at temperatures at or near 1200° C. These bonding temperatures are typically achieved by placing the substrates to be bonded into high temperature annealing ovens.

Polymeric substrates that are thermally bonded on the other hand, will typically utilize lower temperatures and/or pressures than silica-based substrates, in order to prevent excessive melting of the substrates and/or distortion, e.g., flattening of the interior portion of the device, i.e., channels or chambers. Generally, such elevated temperatures for bonding polymeric substrates will vary from about 80° C. to about 200° C., depending upon the polymeric material used, and will preferably be between about 90° C. and 150° C. Adhesives may also be used to bond substrates together according to well known methods, which typically comprise applying a layer of adhesive between the substrates that are to be bonded and pressing them together until the adhesive sets. A variety of adhesives may be used in accordance with these methods, including, e.g., UV curable adhesives, that are commercially available.

Alternative methods may also be used to bond substrates together in accordance with the present invention, including e.g., acoustic or ultrasonic welding, RF welding and/or solvent welding of polymeric parts.

As used herein, the term "microchannel circuit" refers to one or more microscale channels that are disposed between two substrates. In preferred aspects, such channel circuits, or networks, include at least two microscale channels, and preferably at least two intersecting microscale channels. The intersection of channels can include channels which intersect and cross, e.g., at "four-way" intersections, as well as a channel intersection wherein one channel intersects and terminates in another channel, e.g., at a "T" or "three-way" intersection.

Referring now to FIGS. 1–4, an embodiment of a microfluidic shaving aid delivery system is shown for use prior to and/or during the shaving process and is generally identified by reference numeral 100. The microfluidic shaving aid delivery system 100 may be incorporated with the various known types of disposable razors in which the razor (or the useable portion thereof, e.g., a razor head cartridge) is discarded and replaced after a selected number of shaves.

Figure 2:
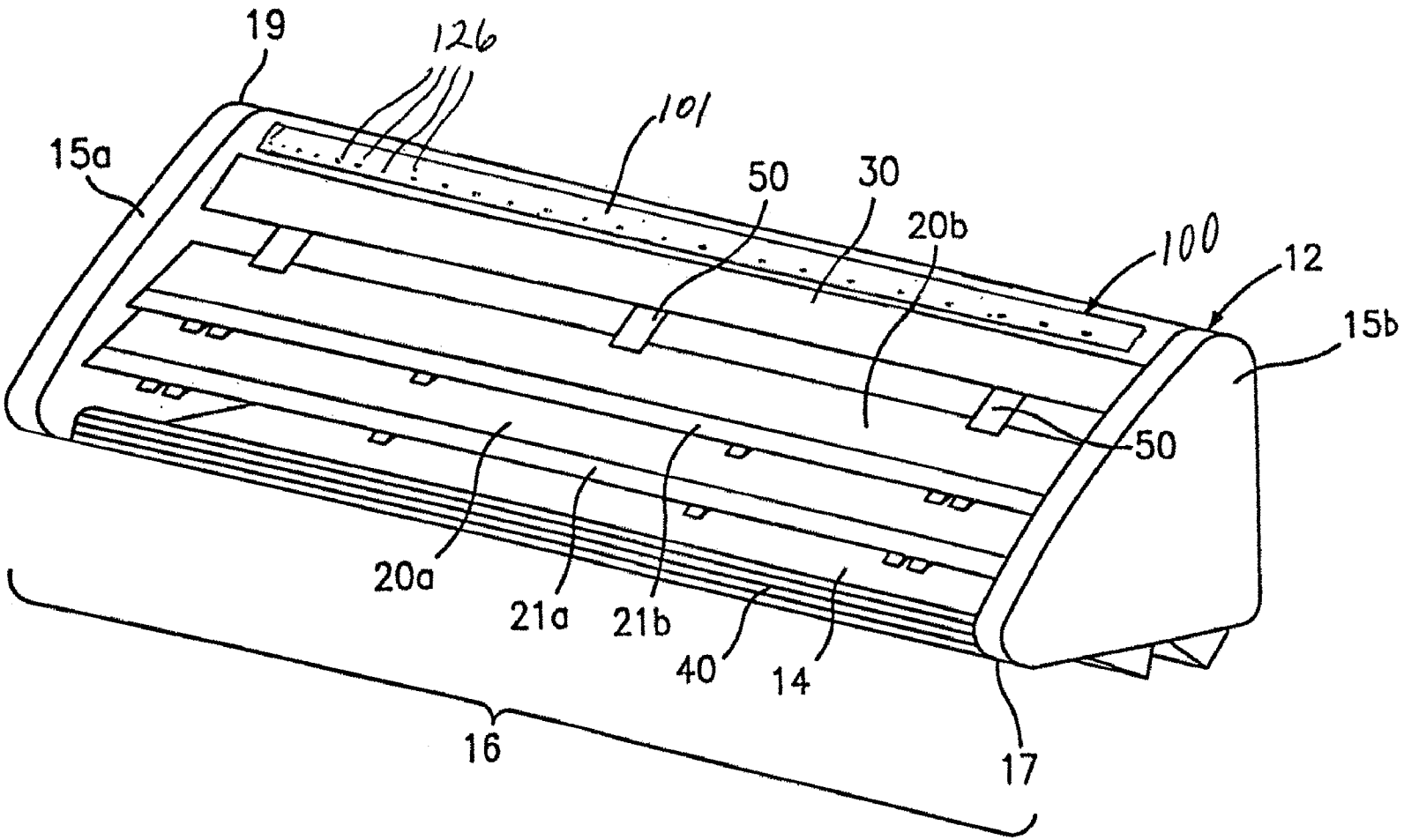
FIG. 2 is a perspective view of the razor head portion of the razor assembly.

The embodiment of the present disclosure illustrated in FIGS. 1 and 2 show a shaving system 10 in the form of a razor head cartridge 12 which includes a support base 14 having resilient supports 50 and 55 which movably connect a pair of sharpened blades 20*a* and 20*b* and a cap member 30 to the support base 14. Although FIGS. 1 and 2 show a shaving system 10 with a disposable and replaceable cartridge 12, the advantages of the present disclosure are equally applicable to other razor designs and shaving systems. As used herein, the term "razor head" is meant to include replaceable cartridges 12 which are designed and manufactured for attachment to a separate razor handle 80, as well as a disposable razor assembly wherein the skin-engaging portions (i.e., guard bar, blades, cap and lubricating shaving strip) are integrally formed with a razor handle section. Moreover, although the shaving systems disclosed herein generally relate to facial shaving systems, it is contemplated that the presently-disclosed shaving aid delivery system may be included with other known shaving systems which engage other bodily skin areas, e.g., legs, arms, areas prepared for surgery, etc.

The razor head 12, includes a support base 14 defined by forward and back surfaces 17 and 19, respectively, and fixed side walls 15*a* and 15*b*. A skin engaging guard member 40 is affixed to the support base 14 along and proximate the forward surface 17 of base 14 and a surface 101 of shaving aid delivery system 100 is disposed along the rear surface 19 of base 14. A seat blade 20*a* and a cap blade 20*b* are supported by a plurality of resilient support members 50 and 55. The tip of each blade 20*a* and 20*b* includes a cutting edge 21*a* and 21*b*, respectively, which refers to the area within about 1 mm from the ultimate tip of each blade 20*a*, 20*b*.

Preferably, the razor blade cutting edge 21*a* and 21*b* are coated with a thin layer of metal coating that provides enhanced durability and corrosion resistance to the underlying metal, e.g., chromium or a chromium/platinum alloy. Other materials may also be coated on a razor blade(s) 20*a*, 20*b* such as, for example, the various coating materials identified in U.S. Pat. No. 5,630,275 which is hereby incorporated in its entirety by reference herein.

It is envisioned that the support members 50 and 55 are attached along base 14 and support each blade 20*a* and 20*b*. The guard member 40, blades 20*a* and 20*b*, cap member 30, lubricating surface 101 of the shaving aid delivery system and the outward facing surfaces of the side walls 15*a* and 15*b* together define the face 16 of the razor head 12. These elements are commonly referred to as "skin engaging elements".

Resilient supports 50 and 55 are disposed at various positions along the face 16 of the razor head 12 to increase the stability of the blades 20*a* and 20*b* and also to provide greater flexibility. It is envisioned that the support members 50 and 55 are designed to have sufficient inherent resiliency to allow the blades 20*a* and 20*b* and cap member 30 to move downwardly relative to side walls 15*a* and 15*b*, i.e. toward base 14, in response to the normal forces encountered during shaving. Preferably, the resilient support members 50 and 55 are manufactured from the same resilient material; however, it is contemplated that the support members 50 and 55 may be manufactured from different resilient materials having varying resiliencies. The length and positioning of the resilient support members 50 and 55 may be also modified to increase or decrease the overall aggressiveness of the shaving geometry in response to forces encountered during shaving. For example, if the length of one resilient support, e.g., 55, is shorter than another resilient support, e.g., 50, the overall shaving angle which directly correlates to the aggressiveness of the shave will change in response to normal shaving forces.

The guard member 40 includes a rear surface 42 which affixes the guard member 40 to the base 14 and an outermost guard surface 41 which is preferably made from a resilient, skin-engaging material having a higher coefficient of friction with wet skin than a rigid plastic of the type commonly used with many disposable razor head cartridges 12. The guard surface 41 is preferably designed to limit the degree to which the razor can be pressed into the skin, which protects the skin from cuts and nicks.

The guard member 40 may be either a single unitary piece or separate segments, as set forth in commonly-owned U.S. Pat. Nos. 5,689,883 and 5,475,923 which are both hereby incorporated in their entirety by reference herein. Preferably, the resilient guard surface 41 is formed from one or more materials selected from polypropylene, Hercuprene 1000, 3000 series, Durometer 30 to 90 A scale available from J-Von, Leominster, Mass.; Kraton G series, Durometer 30 to 90A scale available from Shell Chemical Co., Lisle, Ill.; and Santoprene 2271 series, Durometer 30 to 90 A scale available from Monsanto Co.

It is contemplated that one or more of the above-identified resilient materials may also be disposed on the upper, skin-engaging portions of sidewalls 15*a* and 15*b*. As can be appreciated, the higher coefficient of friction of the resilient material enables the guard member 40 (and the sidewalls 15*a*, 15*b*) to grip the skin and exert greater control of the skin as it flows over the blade(s) 20*a*, 20*b*. Moreover, the resilient material provides a more detectable sensation to the skin in a manner which will tend to mask any unpleasant sensory perceptions of a sharpened blade traveling across the skin.

Cap member 30 seats atop blade 20*b*. The cap member 30 may be formed as a single piece extending across the face 16 of the razor head 12, or the cap member 30 may be segmented into a plurality of individual segments depending upon a particular purpose. It is contemplated that the cap member 30 may be integrally formed with or affixed to one or more of the resilient supports 50, 55 in order to unify the overall movement of the blades 20*a*, 20*b* and the cap member 30 across the skin during a shaving stroke. Other advantages relating to the formation of the cap member 30 are described in commonly-owned U.S. Pat. No. 5,822,862 and U.S. Pat. No. 5,822,862, U.S. Pat. No. 5,666,729 and U.S. Pat. No. 5,456,009 which are all here by incorporated by reference in their entirety herein.

Figure 3:
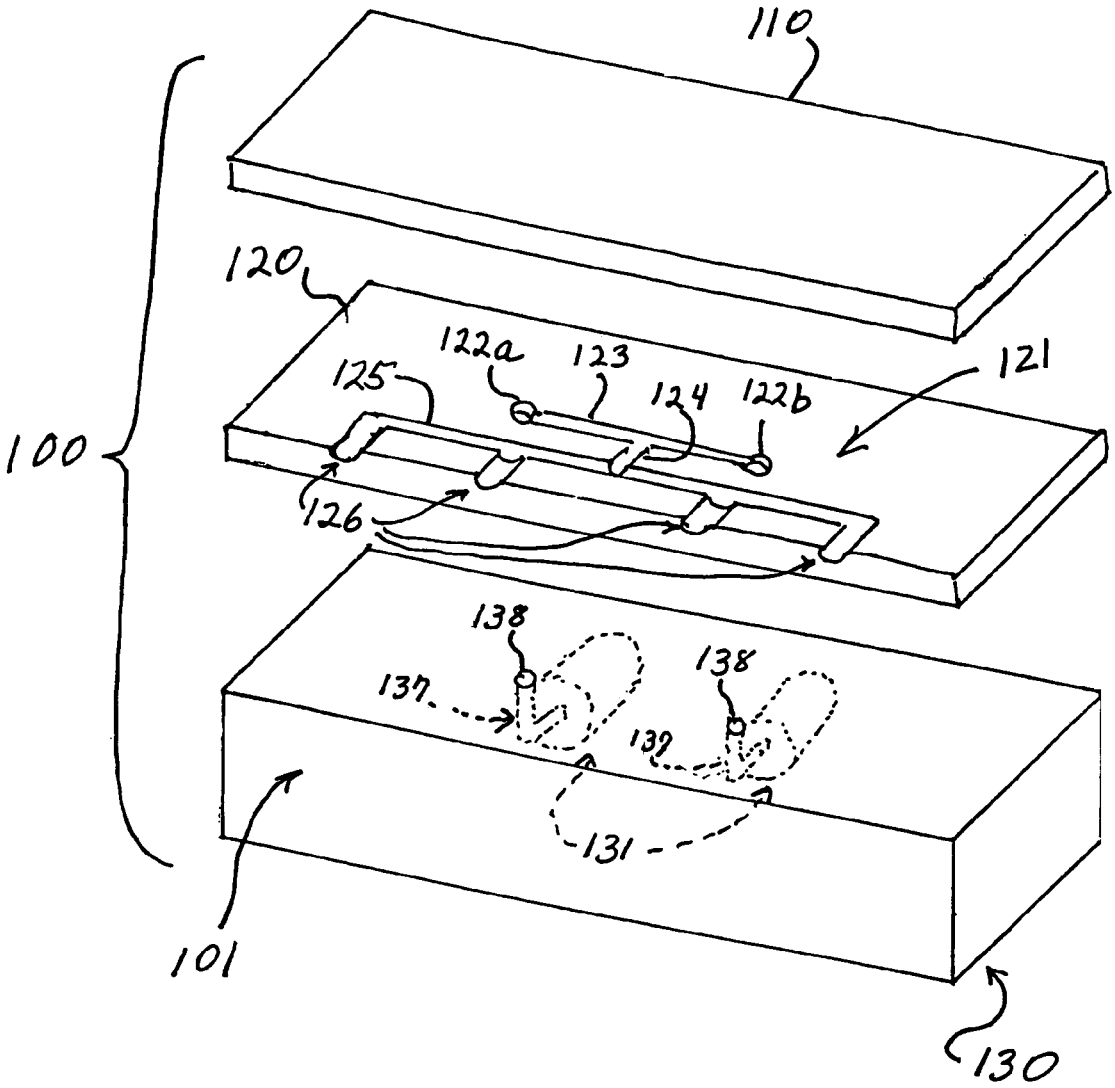
FIG. 3 is an exploded perspective view of the microfluidic shaving aid delivery system.
Figure 4:
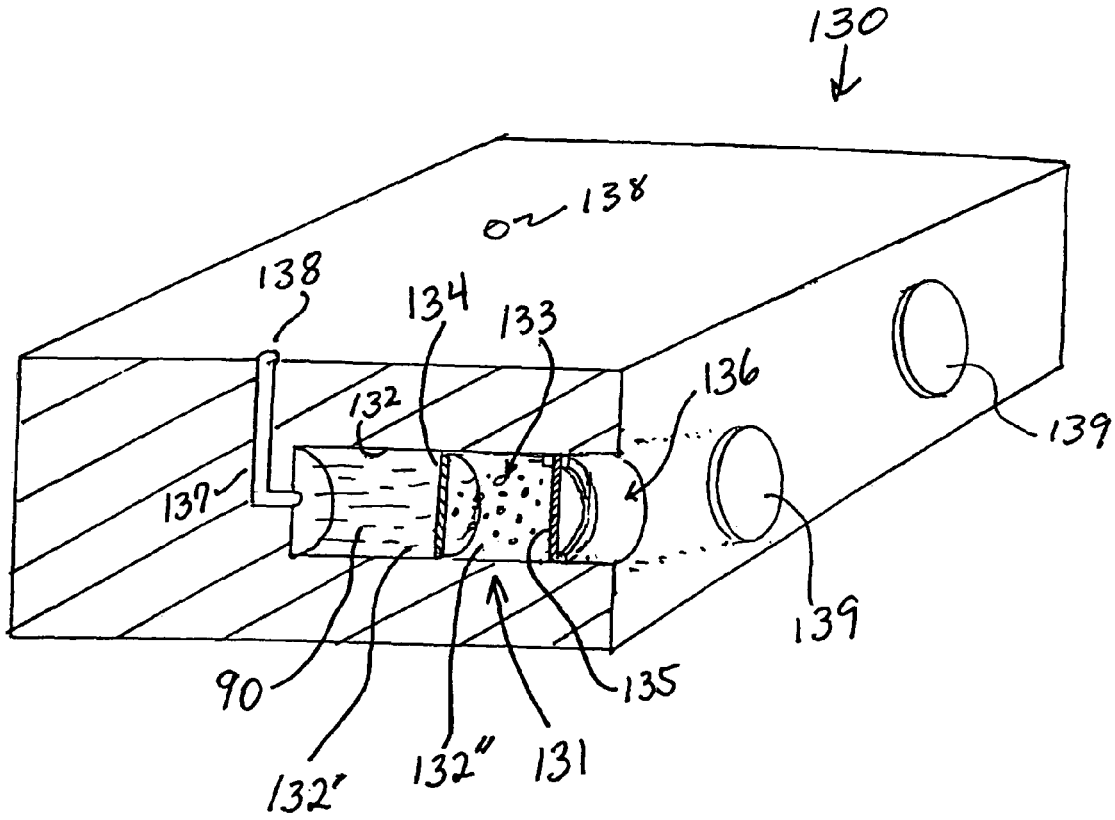
FIG. 4 is a sectional view of a substrate of the microfluidic shaving aid delivery system including osmotic pump transfer system for delivering shaving aid; and, FIG. 5 is a sectional view illustrating an alternative embodiment of the osmotic pump transfer system.
Figure 5:
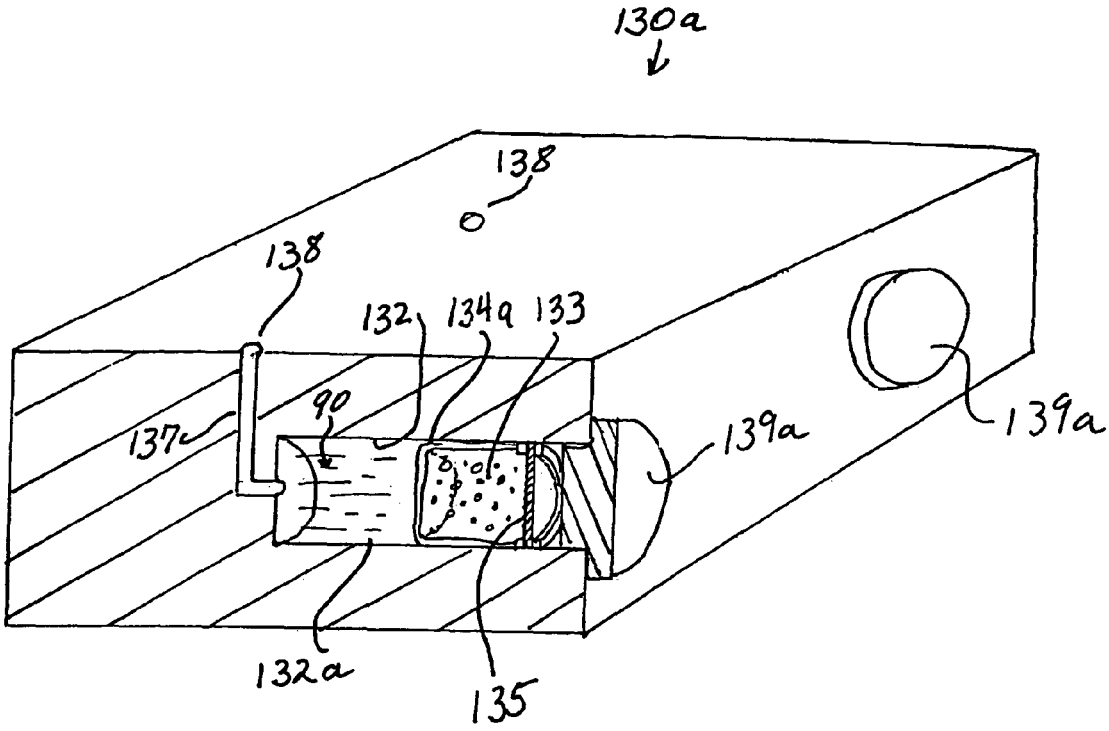

As best illustrated in FIGS. 3,4 and 5, the shaving system 10 includes a shaving aid delivery system 100 according to the present disclosure which is disposed within the razor head 12 for selectively delivering shaving aid either prior to and/or during the shaving process. In one embodiment the shaving aid delivery system 100 can be fixedly incorporated into the razor head 12 and can be employed for multiple uses, or shaves. Alternatively, the shaving aid delivery system can be separable from the razor head 12, and, for example, discarded after a single use and replaced with a fresh shaving aid delivery system.

More particularly, the shaving aid delivery system 100 includes a reservoir for storing a predetermined amount of shaving aid for dispersal along a lubricating surface 101 which engages the skin during the shaving stroke.

As used herein, the term "shaving aid" refers to a large variety of known shave-aiding agents which comprise one or more combinations of the following substances:

A lubricating agent for reducing the frictional forces between the razor and the skin, e.g., a silicone oil;

An agent which reduces the drag between the razor parts and the surface being shaved, e.g., a polyethylene oxide in the range of molecular weight between 100,000 and 6,000,000; a non-ionic polyacrylamide; and/or a natural polysaccharide derived from plant materials such as "guar gum";

An agent which modifies the chemical structure of the hair to allow the razor blade to pass through the whiskers very easily, e.g., a depilatory agent;

A cleaning agent which allows the whisker and skin debris to wash more easily from the razor parts during shaving, e.g., a silicone polyethylene oxide block copolymer and detergent such as sodium lauryl sulphate;

A medicinal agent such as an antiseptic for killing bacteria or other microorganisms, or an agent for repairing skin damage and abrasions;

A cosmetic agent for softening, smoothing, conditioning or improving the skin;

A blood coagulant for the suppression of bleeding that occurs from nicks and cuts;

Essential oils;

Vitamin E, e.g., in a formulation of vitamin E acetate, sodium pyruvate, and sunflower oil, contained on a polytrap bead carrier;

Synthetic moisturizers, lubricants, emollients, e.g., Dimethicone, $C_{12}$–$C_{15}$alcohol benzoates, glycerin, cetyl alcohol and stearyl alcohol;

Natural moisturizers, lubricants, emollients, e.g., jojoba oil, allantoin, aloe vera and sesame oil.

Referring now to FIGS. 3 and 4, the microfluidic shaving aid delivery system 100 includes a first substrate 110, a second substrate 120 and a third substrate 130, secured together in a stacked array. Each of said first, second, and third substrates 110, 120, and 130, can be individually fabricated from a substrate material such as those indicated above, and formed into the desired configuration by any suitable method such as those indicated above.

First substrate 110 is a flat plate which serves as a cover.

Second substrate 120 includes a microchannel circuit 121 including fluid vias 122*a* and 122*b* which extend through the second substrate 120 to allow passage of shaving aid fluid from the third substrate 130 (as described below) into the microchannel circuit 121. The microfluidic shaving aid delivery system 100 can include multiple shaving aids which can be individually selected for delivery to the shaving surface. Each via 122*a* and 122*b* transports an individual shaving aid. While the system described herein employs two shaving aids for illustration purposes, it should be noted that any number of shaving aids can be included in the shaving aid delivery system 100.

Microchannel circuit 121 also includes a lateral channel 123 for carrying the shaving aid fluids to a mixing channel 124 wherein the shaving aids are combined and communicated to an outlet manifold 125. The shaving aid fluid is therein delivered to the multiple outlet ports 126 along the edge of the second substrate 120 whereupon the shaving aid fluid is ejected and delivered to the lubricating surface 101.

The microchannels (i.e., 123, 124, 125) are preferably from about 50μ to 200μ in diameter, more preferably from about 100μ to 150μ in diameter.

The microfluidic shaving aid delivery system 100 further includes at least one reservoir for containing fluid shaving aid, and a transport system for driving shaving aid from the reservoir through the microchannel circuit 121. Preferably, the microfluidic shaving aid delivery system 100 allows the user to select one or more desired shaving aids from among two or more shavings aids stored in the device.

Referring now to FIG. 4, the third substrate 130 includes, as the transfer system, at least one and preferably two or more osmotic pumps 131, each associated with a reservoir containing a specific shaving aid 90.

More particularly, the osmotic pump 131 includes a channel 132 defined by an interior wall in the body of the third member 130. A piston 134 divides the channel 132 into a reservoir portion 132' and a pump chamber 132".

Shaving aid fluid 90 is stored in the reservoir portion 132'.

The pump chamber 132" contains an osmotic driving material 133 which generates pressure by means of expansion as described below. The piston 134 is a fluid impermeable barrier member which is freely and slidably movable in channel 132 in response to expansion of the driving material 133. Piston 134 can be fabricated from metal, plastic, or other suitable material. Preferred materials include acrylics, polycarbonates, PTFE, PVC, and the like. As the driving material 133 expands the piston 134 applies pressure to the shaving aid fluid 90 and drives the shaving aid fluid 90 through channel 137 to outlet 138 whereupon it enters through one of the vias (e.g. 122*a* or 122*b*) into the microchannel circuit 121 for delivery to the lubricating surface 101.

The osmotic driving material 133 is retained by a semipermeable membrane 135 disposed in channel 132 between the driving material 133 and the opening 136 of the channel 132.

The osmotic driving material 133 can contain an inorganic water soluble salt such as sodium chloride, potassium chloride, magnesium sulfate, sodium sulfate, calcium chloride, or lithium chloride, an organic salt such as sodium acetate, or a water soluble organic chemical such as dextrose, lactose, or fructose. The osmotic driving material 133 can be in the form of a solution or solid.

The semipermeable membrane allows the passage of water therethrough, but is impermeable to the driving material. Osmosis will tend to drive water through the semipermeable membrane into the driving medium. This causes an expansion of the driving material, which drives the shaving aid fluid 90 from the reservoir 132' as explained above.

Suitable materials for making the semipermeable membrane are known in the art.

Cellulose acetate is an especially preferred membrane material for this application because its water permeability is high and can be adjusted easily by varying the degree of acetylation of the polymer. The permeability of cellulose acetate membranes can be increased further by adding plasticizers to the polymer to increase the water diffusion coefficient, or by adding hydrophilic flux enhancers, which increase the water sorption of the membrane. Some hydrophilic plasticizers serve both purposes. The effect of the hydrophilic plasticizer polyethylene glycol on the osmotic water permeability of cellulose acetate membranes is substantial; the water permeability is increased more than fourfold by the addition of polyethylene glycol. Addition of the hydrophilic polymer hydroxybutyl methyl cellulose to the cellulose acetate membrane has a similar effect. Thus certain membrane materials can be tailored so that their permeability characteristics are made suitable for the particular application at hand, i.e., so that in the device created the pumped fluid is delivered at the desired flow rate.

Other choices for membrane material include polyamides; nylon 6; nylon 6-6; aromatic polyamides, for example, the aromatic polyamide sold under the name Nomex® (DuPont); cellulose acetate butyrate; ethylcellulose; cellulose nitrate; blends of cellulose acetates of various degrees of acetylation; or various types of cellulosic esters and ethers.

The end 136 of the channel 132 is sealed by, for example, an impermeable barrier 139 which covers the open end 136 to prevent water from entering. To initiate the pumping action, the seal 139 is punctured or removed. The razor head is held under or immersed in water. Water then enters the opening 136 of the channel 132, and diffuses through semipermeable membrane 135 into the osmotic driving medium 133. The driving medium 133 expands, pushing piston 134, and driving the shaving aid 90 through channel 137 into the microchannel circuit 121 and out through outlet ports 126. To stop the pumping action, water can be shaken off the razor, which is thereafter allowed to dry.

The user can select from among two or more different types of shaving aid by puncturing or removing only the seals 139 corresponding to the osmotic pumps 131 containing the desired shaving aid.

Referring now to FIG. 5, an alternative embodiment of the osmotic pump, 131*a*, is shown. Third substrate 130*a* includes at least one, and preferably two or more osmotic pumps 131*a*.

Each osmotic pump 131*a* has a channel 132 in which shaving aid 90 is stored in a reservoir portion 132*a* of the channel. The osmotic driving material 133 is optimally contained in an expandable pouch 134*a*, and is retained by a semipermeable membrane 135. The end of channel 132 is dosed by a plug 139*a*. Upon removal of plug 139*a*, water is permitted to flow into channel 132 and diffuses through semipermeable membrane 135 into the osmotic driving medium 133. The expansion of the osmotic driving medium 133 causes expansion of the pouch 134*a*, which drives the shaving aid fluid 90 through channel 137 and outlet 138.

The pouch 134*a* can be made of any expandable material. Preferred materials for making pouch 134*a* include elastic materials such as natural or synthetic rubber film such as latex, butadiene-styrene rubber, and the like.

While the above description contains many specifics, these specifics should not be construed as limitations on the scope of the invention, but merely as exemplifications of preferred embodiments thereof. For example, while the embodiment illustrated herein includes three substrates, the shaving aid delivery system can alternatively include two substrates wherein one substrate includes both the microfluidic circuit and fluid reservoirs and the other substrate serves as a cover, or cap. Also, while the reservoirs 132' can each contain a different type of shaving aid, it is also within the scope of the invention that the individual reservoirs each contain the same type of shaving aid. Those skilled in the art will envision many other possibilities within the scope and spirit of the invention as defined by the claims appended hereto.

What is claimed is:

1. A razor assembly which comprises:

a) a razor head having at least one blade; and b) a shaving aid delivery system disposed within the razor head, the shaving aid delivery system including a supply of at least one shaving aid fluid, a microfluidic circuit for communicating the shaving aid fluid from the supply to a plurality of outlet ports along a surface of the shaving aid delivery system, and at least one osmotic pump in a substrate for driving the shaving aid fluid from the supply through the microfluidic circuit.

2. The razor assembly of claim 1 wherein the shaving aid delivery system includes at least two substrates stacked together.

3. The razor assembly of claim 1 wherein the shaving aid delivery system includes a first substrate, a second substrate and a third substrate, connected together in a stacked array.

4. The razor assembly of claim 3 including a microchannel circuit between the first substrate and the second substrate.

5. The razor assembly of claim 4 wherein the supply of at least one shaving aid includes at least two reservoirs in the third substrate, each reservoir containing a individual shaving aid, wherein the second substrate includes vias for communicating the shaving aid from the third substrate to the microchannel circuit.

6. The razor assembly of claim 1 wherein the osmotic pump includes a reservoir containing the shaving aid fluid.

7. The razor assembly of claim 6 wherein the osmotic pump includes an osmotic driving material separated from the reservoir by a movable, substantially impermeable barrier.

8. The razor assembly of claim 7 wherein the osmotic driving material is selected from the group consisting of sodium chloride, potassium chloride, magnesium sulfate, sodium sulfate, calcium chloride, lithium chloride, sodium acetate, dextrose, lactose and fructose.

9. The razor assembly of claim 8 wherein the barrier is a slidably movable piston.

10. The razor assembly of claim 7 wherein the osmotic pump includes a semipermeable membrane disposed between the osmotic driving material and an inlet opening in the osmotic pump.

11. The razor assembly of claim 10 wherein the semipermeable material is selected from the group consisting of cellulose acetate, polyamide, cellulose acetate butyrate; ethylcellulose, cellulose nitrate and combinations thereof.

12. The razor assembly of claim 10 wherein the inlet opening is covered by a removable or breakable seal.

13. The razor assembly of claim 1 further including a handle to which the razor head is attached.

14. The razor assembly of claim 1 wherein the shaving aid is selected from the group consisting of silicone oil, polyethylene oxide, non-ionic polyacrylamide, guar gum, depilatory agent, a silicone polyethylene oxide block copolymer, sodium lauryl sulphate, antiseptic, skin conditioner, blood coagulant, vitamin E, sodium pyruvate, sunflower oil, Dimethicone, $C_{12}$–$C_{15}$ alcohol benzoate, glycerin, cetyl alcohol, stearyl alcohol, jojoba oil, allantoin, aloe vera and sesame oil.

15. The razor assembly of claim 1 wherein the supply of shaving aid includes at least two reservoirs, each reservoir containing an individual shaving aid fluid of the same or different type, and the shaving aid delivery system includes means for selecting one or more of the shaving aid fluids for delivery to the outlet ports.

16. The razor assembly of claim 15 wherein the shaving aid delivery system includes an individual osmotic pump for delivering each individual shaving aid fluid, each osmotic pump including an inlet for admitting water therein for driving the osmotic pump, and wherein the means for selecting one or more shaving aid fluids comprises a removable or breakable seal disposed across each inlet.

* * * * *